United States Patent [19]

Goda

[11] Patent Number: 4,464,974

[45] Date of Patent: Aug. 14, 1984

[54] DEVICE FOR THE SHOOTING SIMULATION OF SIGHT-CONTROLLED MISSILES

[75] Inventor: Wilfried Goda, Hamburg, Fed. Rep. of Germany

[73] Assignee: Precitronic Gesellschaft, Hamburg, Fed. Rep. of Germany

[21] Appl. No.: 381,930

[22] Filed: May 26, 1982

[30] Foreign Application Priority Data

May 29, 1981 [DE] Fed. Rep. of Germany ..... 3121488

[51] Int. Cl.[3] ..... F41G 3/32

[52] U.S. Cl. ..... 89/41 L; 244/3.11; 434/22

[58] Field of Search ..... 89/41 L; 434/21, 22; 244/3.11

[56] References Cited

U.S. PATENT DOCUMENTS 3,609,883 10/1971 Erhard ..... 434/22
4,173,414 11/1979 Vauchy et al. ..... 89/41 L
4,246,705 1/1981 Lee ..... 434/22
4,315,689 2/1982 Goda ..... 89/41 L

*Primary Examiner*—Charles T. Jordan
*Attorney, Agent, or Firm*—Arnold, White & Durkee

[57] ABSTRACT

A device for evaluating the sighting of a target by a sighting unit along its line-of-sight during shooting simulation of a sight-controlled missile is disclosed. A laser transmitter/receiver unit is coupled to the sighting unit with independent movement therewith in at least one direction. The transmitter/receiver generates a reference light beam having a direction parallel to the transmitting direction of the transmitted laser beam. The reference beam is focused into the sighting unit and onto an angle measuring means which measures the angle between the radiation received from a missile and the line-of-sight of the sighting unit. The angle measuring means generates misalignment signals representing the angle deviation between the reference beam and the line-of-sight. These signals are then processed by a processing unit to evaluate the sighting of the target by the sighting unit.

10 Claims, 2 Drawing Figures

DEVICE FOR THE SHOOTING SIMULATION OF SIGHT-CONTROLLED MISSILES

BACKGROUND OF THE INVENTION

The present invention relates to laser shooting simulation, and more particularly, the invention relates to a device for the evaluation of a target sighting by means of a laser assisted sighting device during the simulation of shooting with sight-controlled missiles.

Laser sighting devices having a laser transmitter to transmit laser signals, a laser receiver for receiving reflected laser light reflected from a target, a device to determine the angle misalignment between the laser signals and the line-of-sight of the sighting unit, and an evaluation device for the angle misalignments are well known. For example, the device disclosed in German Pat. No. 2,846,962 discloses a laser transmitter that is rigidly coupled with the sighting device where the transmitter must be adjusted in a precise and permanent manner with respect to the line-of-sight. Frequently, there are difficulties in arranging the error compensating control system (laser transmitter and receiver) of the shooting simulation device in this precise and permanent manner, with an optical axis parallel to the line-of-sight of the sighting device. This is especially true in the case of sighting devices which form a part of a weapon's guidance system for a tank.

The weapon's guidance system of a tank includes a periscopic aiming device with rotatable reflectors for at least providing vertical deflection (corner reflectors, etc.) of the area viewed by the aiming device. In such a case, an external, rigid coupling of the laser transmitter is not possible, at least with respect to the vertical movements of the sighting device. Further, the integration of the laser beam into the line-of-sight of the periscopic aiming device is frequently prohibitive because of cost considerations, and furthermore, it becomes impossible to use the shooting simulation device with aiming sights of a different construction without changing the manner in which the laser beam is integrated into the beam path of the periscopic aiming device. Other physical reasons, e.g., lack of agreement between the wavelength of the laser signals transmitted by the laser transmitter in the optical pass range of the aiming devive, can also make the introduction of the laser beam into the sighting device impossible.

In German Pat. 2,008,986, a shooting simulation device for sight-controlled missiles is disclosed in which a laser transmitter tracks the movements of the sighting device by means of servomotors. By means of special simulation signal generators, deviations between the alignment of the laser transmitters and the sighting device can be produced corresponding to the dynamic guided behavior of a missile in flight. A light source connected with the laser transmitter inserts into the sighting device a light beam (seen in the sighting device as a point of light) which reproduces the optical impression of the guided missile. However, the position of this light beam is not used for the evaluation of the shot. The tracking device needed with the device of German Pat. No. 2,008,986 for the laser transmitter cannot, in principal, operate with the accuracy of an inertial platform required for an exact shot evaluation. Basically, for a shot evaluation, a measurement accuracy of less than 0.15 mrad is required from such a shooting simulation device whereas tracking devices which can be obtained on the market operate at best with accuracies of ±2 mrad.

Thus, it would be advantageous to provide a device for evaluating the sighting of a target with reference to the line-of-sight axis of a sighting device where all the data required to evaluate the shooting simulation is obtained with a comparatively low expenditure and with high precision. It would also be advantageous to provide a shooting simulation evaluation without requiring a rigid axis-parallel coupling and an adjustment of the laser transmitter to the sighting device or an optical integration of the laser transmitter into the beam path of the sighting device or an exact tracking of the laser transmitter into the line-of-sight.

SUMMARY OF THE INVENTION

In accordance with the present invention, a device for evaluating the sighting of a target by a sighting unit along its line-of-sight during shooting simulation of a sight-controlled missile is provided. The missile is guided by a guidance means to follow the line-of-sight of the sighting unit. The sighting unit includes an angle measuring means for measuring the angle between the radiation received from the missile and the line-of-sight of the sighting unit.

The evaluation device includes a laser transmitter/-receiver coupled to the sighting unit with independent movement thereto possible in at least one direction. The laser transmitter transmits a laser beam in a transmitting direction to a target. The laser receiver detects reflected laser light from the target. Also included in the transmitter/receiver is a reference light beam having a direction parallel to the transmitting direction of the transmitted laser beam.

A focusing means is attached to the sighting unit for focusing the reference beam into the sighting unit and onto the angle measuring means. In response to the reference beam, the angle measuring means generates misalignment signals representing the angle deviation between the reference beam and the line-of-sight of the sighting unit. A processing unit responds to the misalignment signals and to the laser transmitter/receiver unit for evaluating the sighting of the target by the sighting unit.

In contrast to the prior art, the rigidly adjusted reference between the line-of-sight and the transmitting direction of the laser beam is absent in the present invention in at least one dimension. The laser transmitter/-receiver detects the target by means of a scanning or tracking movement, independent of the sighting device, and the necessary reference to the line-of-sight is obtained by measuring the angle misalignment between the transmitting device and the momentary position of the line-of-sight. Measurement of the angle misalignment is accomplished by means of the reference radiation beam which is parallel to the laser transmitting direction and focused into the sighting device where its angle relative to the line-of-sight is determined by the angle measurement means contained in the sighting unit.

The device in accordance with the invention offers the special advantage that interventions into the mechanics and/or the optical beam path by available sighting devices are not required. The coupling between the sighting device and the laser transmitters is provided for by the focusing of the reference radiation beam into the aperture of the sighting device from the front. The invention can make use of the fact that off-the-shelf sighting devices can be used, such as those designed as directional or guidance devices for the production of guidance signals for guided missiles.

These sighting devices contain an angle measurement device (goniometer) which responds to the characteristic radiation of the missile. Such customary directional sighting devices can be used with the shooting simulation device in accordance with the invention without any adjustment required, if care is taken that the reference radiation beam is adapted to the characteristic radiation of the missile to be simulated with respect to its wavelength and intensity.

In another more advantageous specific embodiment of the invention, a sampling of the misalignment signals is carried out by connecting a signal gate to the measuring device which can be time controlled by the laser receiver to allow the misalignment signals to pass through to a processing unit or to an intermediate memory, only upon receiving laser radiation reflected from the target. Therefore, only those signals which are present upon the appearance of a retroreflection from a target are evaluated to reproduce the misalignment between the ideal aiming point represented by the laser transmitter at a particular moment and the actual aiming point.

BRIEF DESCRIPTION OF THE DRAWINGS

For a fuller understanding of the invention reference should be had to the following detailed description taken in conjunction with the accompanying drawings in which.

DETAILED DESCRIPTION OF THE PREFERRED EMBODIMENT OF THE INVENTION

Figure 1:
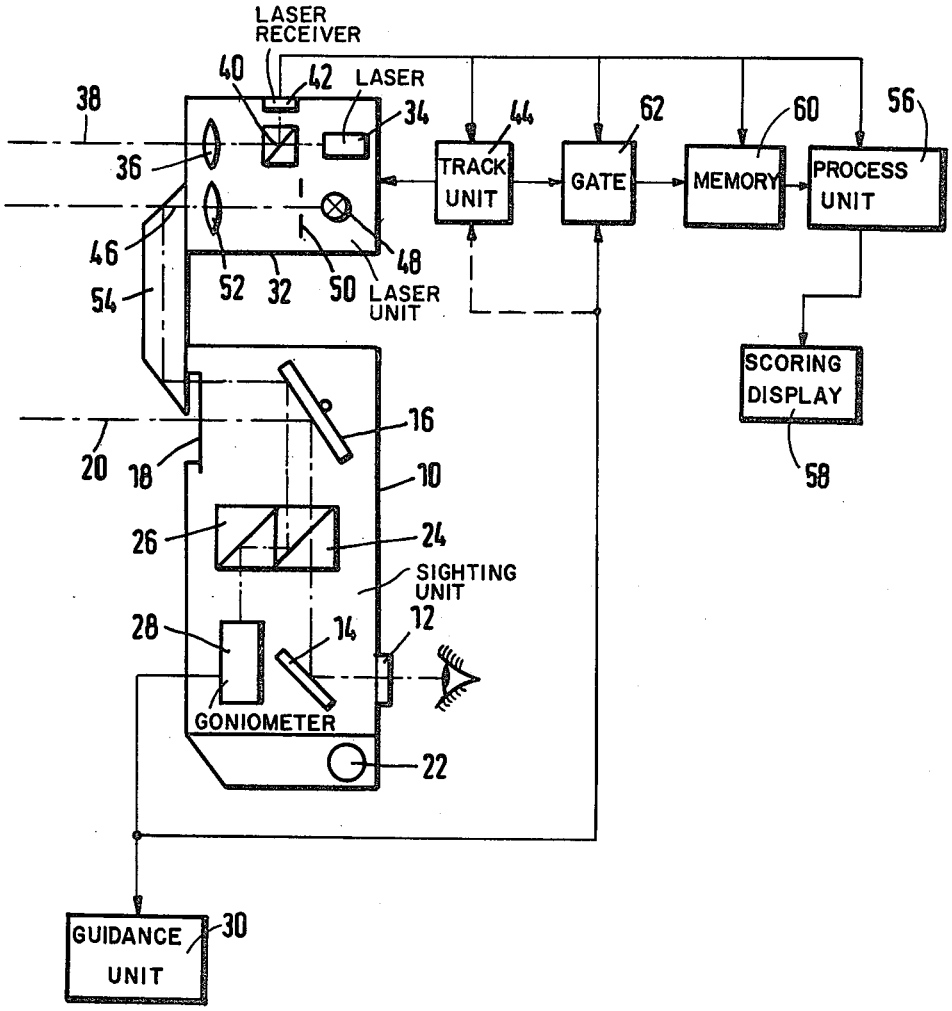
FIG. 1 schematically shows the periscopic directional and guidance parts of a sighting device, as well as the laser transmitter and the processing unit of the shooting simulation device in accordance with the first specific embodiment of the invention.

The number 10 in FIG. 1 indicates the optics designed as a periscopic directional device, especially as it applies to tanks. It is possible to observe and take aim along a line-of-sight 20 determined by, for example, cross-hairs via the eyeglass 12 and two tilted reflectors 14, 16 and an aperture 18. For the lateral directional movements, the sighting device as a whole can turn around a vertical axis. For the elevation directional movements, the upper tilted mirror 16 can be adjusted around a horizontal axis by means of a directional adjuster 22.

A beam splitter 24 and a tilted reflector 26 are arranged in the beam path of the sighting device. Through these, the characteristic radiation of a guided missile (typically radiation in the infrared range) coming in via the aperture 18 is directed onto an angle measuring device (goniometer) 28. The goniometer 28 produces signals corresponding to the angle misalignment between the momentary position of the missile which produces the characteristic radiation and the line-of-sight 20. These signals are conveyed to a guidance device 30 during actual shooting where the guidance device generates and transmits the required guidance signals to the missile.

For simulation of the shooting, a laser transmitting unit 32 is provided. Laser unit 32 contains a laser transmitting element 34 which transmits laser radiation along an axis 38 via an optical system indicated by 36. Received laser radiation reflected from a target is applied to a receiver 42 via a beam splitter 40.

Figure 2:
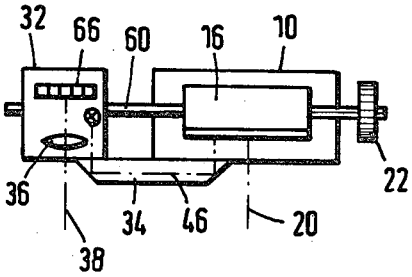
FIG. 2 schematically shows a top view of the laser transmitter and the periscopic directional part of the sighting device in accordance with an alternate embodiment of the invention.

The laser transmitting unit 32 is rigidly coupled to the sighting device 10 with respect to horizontal movements. It can sit, for example, as represented in FIG. 2, on the prolonged axis or shaft 60 of the upper tilted mirror 16. It can (but need not) also follow the swivel movements of the upper tilted mirror 16 in the vertical direction. In such a case, a parallelness between the transmitting direction 38 and the sighting device axis 20 is not guaranteed since the line of sight 20 is rotated by twice the amount as the tilted mirror 16 when the mirror is rotated.

For the evaluation of the shot simulated by means of the laser, it is necessary to determine the angle between the direction in which the target reflecting the laser radiation is located and the line-of-sight 20 during at least a part of the flying time of the simulated missile, and to evaluate it for a scoring indication. This is done with the device in accordance with the invention as follows:

With regard to the horizontal direction, there is an immobile reference between the laser transmitter and the line-of-sight 20. It is therefore enough, if the target deflection from a reference line of the laser transmitter is determined by means of the reflected laser signals. This is accomplished by transmitting a laser beam from a horizontally arranged series of laser transmitting elements 66, one after the other, and in this way, scanning the target area horizontally so that from the code and/or the temporary reference of the retroreflected signals, it is possible to determine the lateral angle deflection of the target.

With regard to the vertical movement, the laser transmitting unit 32 is designed as a unit to turn at any elevation angle which is also attainable by the periscopic sighting device 10. The laser transmitting unit 32 is swivelled continuously over this vertical angle range by means of a motor-adjusting device (not shown). In this way, the laser transmitting elements 66 transmit laser impulses in a sequence which guarantees that measurement lines are illuminated which follow one after the other via the vertical swivel movement.

As soon as the ideal aiming point is reached, at least one laser transmitting element 34 illuminates the target which is preferably equipped with suitable retroreflectors, and the retroreflected laser radiation is depicted on the receiver 42 by the lens 36 via the beam splitter 40. The vertical swivel movement of the laser transmitting unit 32 is controlled by a tracking control 44 which can be controlled by the receiver 42 in such a manner that after the detection of a retroreflecting target, the laser transmitting unit 32 is again and again conducted over the target which represents the ideal aiming point.

In the laser transmitting unit 32, there is also a device for the production of a reference radiation beam whose axis 46 can be adjusted exactly parallel to the transmitting direction 38 of the laser signals. This device has a collimator beam path and is indicated in the figure by a light source 48, a screen 50 and a parallel-directed optical system 52. A deviating prism 54, which deviates the beam direction 46 by exactly 180°, is arranged in such a manner that it partially overlaps the aperture 18 of the sighting device directional unit 10 so that the reference radiation beam 46 focuses in the aperture 18 in exactly the opposite parallel direction as the transmitting direction 38 of the laser signals, and reaches the goniometer 28 via the tilted mirror 16 and beam splitter 24. The reference radiation beam is produced with such a wavelength, intensity and parallelism that it can be detected by the goniometer 28 in the same manner and with the same accuracy as the characteristic radiation originating from a real missile. Preferably, the wavelength of the reference radiation beam lies in the infrared range.

The goniometer generates signals which correspond to the angle misalignment between the reference radiation beam 46, and therefore, the axis of the laser beam transmitting direction 38, and the line-of-sight 20. At any moment of the measured retroreflection, these signals are, for example, a voltage which is proportional to the misalignment of the actual aiming point from the ideal aiming point. The receiver 42 controls a sensor 62 in such a way that only the voltage values which are available at the moment of the retroreflection are allowed through and are conveyed to an intermediate memory 60 where they are temporarily stored before evaluation in the processing unit 56. By evaluation of the angle misalignment of the laser transmitting direction 38 (which is directed constantly toward the target) from the line-of-sight 20 during at least a part of the flying time of the simulated missile (especially during the last part of this flying time) it is possible to obtain a scoring indication which is indicated by scoring indicator 58.

The device in accordance with the invention can be supplemented by additional devices which are, in part, already known. In particular, a device can be provided which determines the distance to the target from the laser signals reflected from the target. From this distance, the flying time of the simulated missile can be determined and used in the evaluation of the simulated shot.

In another specific embodiment of the invention, the tracking-guidance device 44 can be designed in such a manner that in the presence of several reflecting targets it maintains the transmitting direction 38 directed toward that target which is closest to the line-of-sight, i.e., produces the smallest deflection voltage in the goniometer 28. The emitted signal of the goniometer 28 can also be conveyed to the tracking-guidance unit 44. (This is shown in FIG. 1 as a dotted line.)

Furthermore, in accordance with the invention, provision is made so that the laser transmitting unit 32 is connected with the aiming unit 10 of the sighting device by means of a rough tracking device (not shown), where the misalignment signals of the goniometer 28 are made smaller.

In another embodiment of the invention, the laser transmitting unit 32 can also be used to transfer information to the target by a suitable coding of the laser signals. In particular, information concerning the result of the scoring evaluation can be initiated by suitable effects on the target, for example, shot indication, damage representation of the effect of a hit, etc. For this purpose, a coding device (not shown) can control the laser transmitting element 34 in response to the processing unit 56.

Summarizing the invention, the coupling of a laser transmitter (for shooting simulation) to a sighting device, equipped in particular with periscopic aiming devices, is done in accordance with the invention and without being mechanically immobile and in a manner so that a reference light beam, parallel and opposed to the laser radiation direction, is focused into the aperture of the sighting device; and, the angle misalignment between the reference light ray and the sighting device lens is detected and is evaluated in the calculation for the evaluation of the laser signals reflected from the target. The invention is suitable, above all, for the shooting simulation of guided missiles. In this case, the goniometer provided in the sighting device for the guidance of the missile can also serve for the angular detection of the reference light beam adapted to the characteristic radiation of a particular missile.

In describing the invention, reference has been made to its preferred embodiment. However, those skilled in the art and familiar with the disclosure of the invention may recognize additions, deletions, substitutions or other modifications which would fall within the purview of the invention as defined in the appended claims.

I claim:

1. A device for evaluating the sighting of a target by a sighting unit along its line-of-sight during shooting simulation of a sight-controlled missile where the missile is guided by a guidance means to follow the line-of-sight of the sighting unit, the sighting unit including an angle measuring means for measuring the angle between the radiation received from the missile and the line-of-sight of the sighting unit, the device comprising:

(a) a laser transmitter/receiver coupled to the sighting unit with independent movement thereto in at least one direction, for transmitting a laser beam in a transmitting direction to the target and for detecting reflected laser light therefrom, said transmitter/receiver generating a reference light beam having a direction parallel to the transmitting direction of the transmitted laser beam;

(b) a focusing means attached to the sighting unit for focusing the reference beam into the sighting unit and onto the angle measuring means, said angle measuring means generating misalignment signals representing the angle deviation between the reference beam and the line-of-sight of the sighting unit; and (c) a processing means responsive to the misalignment signals and said laser transmitter/receiver for evaluating the sighting of the target by the sighting unit.

2. The device of claim 1 wherein the sighting unit is a guidance device for guided missiles and wherein (a) said angle measuring means responds to the characteristic radiation from a missile to produce guidance signals corresponding to the misalignment of the missile from the line-of-sight of the sighting unit, and (b) where the wavelength and intensity of the reference beam focused into the sighting unit is similar to the characteristic radiation of a missile in flight.

3. The device of claim 2 wherein said angle measuring means is a goniometer.

4. The device of claims 1, 2 or 3 wherein said processing means includes:

(a) a signal gate responsive to the detection by said laser transmitter/receiver of reflected laser light from the target for gating the misalignment signals from the angle measuring means;

(b) a memory responsive to said signal gate for storing the misalignment signals;

(c) a processing unit responsive to the misalignment signals for determining the sighting of a target during shooting simulation; and (d) a display for displaying the results of the sighting evaluation by said processing unit.

5. The device of claim 4 wherein said laser transmitter/receiver is rigidly coupled to the sighting unit with respect to horizontal movement and the transmitting direction of the laser beam is adjusted parallel to the line-of-sight of the sighting unit, and where the direction of independent movement of said laser transmitter/receiver is in the vertical direction.

6. The device of claim 5 wherein said laser transmitter/receiver detects the horizonal angle deflection of a target from the line-of-sight of the sighting unit.

7. The device of claim 6 wherein said laser transmitter/receiver further comprises:

(a) a plurality of laser transmitting elements arranged in a horizontal line whereby sequential transmission from each said element one after the other results in a horizontal scanning of the target area viewed by the sighting unit; and (b) a tracking means connected to said laser transmitter/receiver and responsive to the detected reflected laser light for rotating the transmitted laser beam vertically through an elevation angle, the horizontal scanning by said laser elements cooperating with the vertical rotation to scan the entire target area viewed by the sighting unit.

8. The device of claim 7 wherein said tracking means (a) executes a periodic scanning movement which comprises the entire angular position range of the sighting unit, and (b) in response to the lateral displacement of the target from the line-of-sight, automatically controls the position of said laser elements to track movement of the target.

9. The device according to claim 8 wherein said laser transmitter/receiver is connected to the sighting unit by a rough tracking unit having a tracking error range so that automatic tracking of movement of the target occurs within the range of the tracking error of said rough tracking device.

10. The device of claim 8 wherein said tracking means controls tracking of movement of a target so that in the presence of several reflecting targets, said laser transmitting elements are automatically directed to track the target lying closest to the line-of-sight of the sighting unit.

* * * * *